US009809290B2

(12) United States Patent
Willows

(10) Patent No.: US 9,809,290 B2
(45) Date of Patent: Nov. 7, 2017

(54) SYSTEM AND APPARATUS FOR OUTBOARD WATERCRAFT TRIM CONTROL

(71) Applicant: Kurt D. Willows, Gig Harbor, WA (US)

(72) Inventor: Kurt D. Willows, Gig Harbor, WA (US)

( * ) Notice: Subject to any disclaimer, the term of this patent is extended or adjusted under 35 U.S.C. 154(b) by 0 days.

(21) Appl. No.: 15/027,667

(22) PCT Filed: Feb. 25, 2015

(86) PCT No.: PCT/US2015/017570

§ 371 (c)(1),
(2) Date: Apr. 6, 2016

(87) PCT Pub. No.: WO2015/130818

PCT Pub. Date: Sep. 3, 2015

(65) Prior Publication Data

US 2016/0368579 A1 Dec. 22, 2016

Related U.S. Application Data

(60) Provisional application No. 61/966,572, filed on Feb. 26, 2014.

(51) Int. Cl.

| | |
|---|---|
| ***B63H 5/20*** | (2006.01) |
| ***B63H 5/125*** | (2006.01) |
| ***B63H 20/08*** | (2006.01) |
| ***B63H 20/10*** | (2006.01) |
| ***B63H 20/06*** | (2006.01) |

(52) U.S. Cl.
CPC ..... *B63H 20/10* (2013.01); *B63H 20/06* (2013.01)

(58) Field of Classification Search
CPC ..... B63H 20/00; B63H 20/06; B63H 20/08; B63H 20/10; B63H 2020/00; B63H 2020/02; B63H 2020/08; B63H 2020/10
USPC ..... 440/61 T, 53
See application file for complete search history.

(56) References Cited

U.S. PATENT DOCUMENTS

| | | | | |
|---|---|---|---|---|
| 5,782,662 | A | 7/1998 | Icenogle | |
| 6,132,271 | A * | 10/2000 | Hebert | B63H 20/106 440/53 |
| 6,273,771 | B1 | 8/2001 | Buckley et al. | |
| 6,409,556 | B1 | 6/2002 | Vance | |
| 6,890,227 | B1 | 5/2005 | Alby | |
| 6,923,136 | B1 * | 8/2005 | D'Alessandro | B63H 20/08 114/285 |
| 7,311,570 | B2 | 12/2007 | Csoke | |
| 7,416,459 | B1 * | 8/2008 | Pelini | B63H 20/106 440/61 R |
| 7,513,810 | B1 * | 4/2009 | Pelini | B63H 20/10 440/61 R |
| 7,731,552 | B1 * | 6/2010 | Pelini | B63H 20/06 440/53 |

(Continued)

*Primary Examiner* — Daniel V Venne
(74) *Attorney, Agent, or Firm* — Seed IP Law Group LLP

(57) ABSTRACT

An outboard motor mounting apparatus for outboard motors that control the outboard motor propeller thrust line angle of attack through a larger range than is currently available in practice today, including afterplanes (hydrodynamic lifting surfaces) in order to create boat stern lift. The afterplanes move to provide lift with a trimmable hinged portion in combination with movement of the outboard motor propeller thrust line.

9 Claims, 16 Drawing Sheets

(56) References Cited

U.S. PATENT DOCUMENTS

| | | | | |
|---|---|---|---|---|
| 8,627,779 | B2 | 1/2014 | Witte | |
| 2007/0221113 | A1 | 9/2007 | Detwiler et al. | |
| 2009/0142973 | A1* | 6/2009 | Witte ..... | B63H 20/106<br>440/53 |

* cited by examiner

SYSTEM AND APPARATUS FOR OUTBOARD WATERCRAFT TRIM CONTROL

BACKGROUND

Technical Field

The present disclosure pertains to the control of marine vessels and, more particularly, to a mounting apparatus for outboard motor propelled watercraft that increases trim control capabilities.

Description of the Related Art

Watercraft driven by outboard motors typically have the outboard motor mounted to the transom at the stern of the boat. FIGS. 1-3 illustrate a known watercraft, in this case an outboard boat 50 having a hull 52 with a transom 54 at the stern 56 of the boat 50. Attached to the transom 54 is a thrust generator in the form of an outboard motor 58. The outboard motor 58 is typically mounted to the transom 54 with an integral mounting bracket 60, all of which is well known and will not be described in detail herein.

Bow rise is a common problem with marine outboard powered planing boats. As the thrust of the outboard motor 58 first pushes the stern 56 of the boat 50 forward, and the boat starts to proceed up onto plane, the stern squats in the water 62 relative to the bow 64, as shown in FIG. 3. As the boat 50 continues to transition onto plane under increased power from the outboard motor 58, the bow 64 may rise further, causing obstruction to visibility, as shown in FIG. 3.

To mitigate this common problem, outboard powered boats and outboard motors have features designed to improve transom lift. Outboard powered boats have transoms fabricated or molded at a predetermined angle to the boat's keel. This angle to the keel line is typically fixed at ten to fifteen degrees greater than perpendicular, with the top of the transom being further aft than the transom's intersection with the keel. Additionally, outboard motors have a predetermined level of minimum propeller trim where the outboard motor is trimmed firmly up against its integral mounting bracket, mounted to the boat's transom. In conjunction with the outboard powered boat transom angles, this minimum level of outboard motor trim adjustment results in positioning of the outboard propeller shaft and forward thrust line at a positive angle of attack to the water surface, creating moderate lift at the transom of outboard powered vessels.

This combination of characteristics is designed to help outboard powered boats up onto plane and has the benefit of dropping the boat's bow relative to the stern so that from the operator's vantage point, visibility is improved. Additionally, as the vessel's keel retains a more parallel direction to the surface of the water, the outboard powered boat's efficiency is improved during planing as opposed to a situation where there is less lift created at the stern. As well, outboard engines normally include a cavitation plate positioned substantially parallel and above the prop shaft and propeller to inhibit cavitation. In addition to the boat transom angle and propeller thrust and lift, the outboard motor cavitation plate can also provide stern lift at certain outboard motor trim adjustment angles where the outboard motor is trimmed firmly up against its integral mounting bracket or where the cavitation plate, as with the prop shaft, is at a positive angle of attack relative to the water surface. Additionally, afterplanes, moveable planing surfaces commonly used on larger, heavier boats, are not commonly employed on smaller outboard powered boats, due to rigging complexity, space, and cost.

It is therefore important to create stern lift while the boat is getting up on plane, and in many outboard powered boats, where there is an aftward weight bias, the conventional marine boat propulsion system characteristics described above are not optimized for best visibility and efficiency.

The thrust line that is most effective for these types of boats varies depending upon a number of factors. A boat coming onto plane will perform best with amplified lift aft at sub- and pre-planing speeds, and before the hull's planing lift characteristics take over. During this pre-planing period additional transom angle is desired, and afterplanes may also be suitable. For boats with lower wetted length to chine beam ratios the need for stern lift during planing will be most pronounced.

In the past, fixed wedges have been added between the outboard motor and the transom to change the prop shaft thrust line, but this practice is uncommon as it is still experimental and has met with mixed results. For example, adding wedges to a boat not needing significant transom lift will reduce positive trim, and in some cases where positive trim is needed to lift the bow and reduce wetted area, boat speed can be compromised.

Boats are also subjected to running environments that may vary during operation. For example, a boat with a motor mounted at a transom angle best for low speeds may have impaired performance when the outboard powered boat is planing or when operating in a following sea, where stern lift is amplified by the surfing effect of a following sea. In this case the increased effective transom angle caused by fixed wedges permanently reduces outboard motor positive trim range and may adversely affect handling. The preset nature of the fixed wedge does not allow for tailoring or "dialing in" of the effective transom mounting angle to minimize undesirable handling characteristics of a particular boat type without completely removing and replacing the outboard motor and wedges, thus making the process of refining the set-up a tedious job.

In another approach, U.S. Pat. Pub. No. US 2007/0221113 A1 describes a moveable trim tab mounted to a hydraulic vertical engine lift bracket, allowing the boat operator to adjust the trim tab simultaneously along with the hydraulic engine lift. During some modes this functionality may be problematic as when operating at very high speeds, the hydraulic engine lift used on outboard performance boats may be raised to reduce parasitic drag caused by the gear case and propeller. As the boat is operated at very high speeds, the underside of the outboard motor gear case skis across the surface of the water, creating steerage along with the surfacing propeller. In this mode the steering footprint is greatly reduced, so lowering a trim tab independently ahead of the engine is at odds with the delicate high-speed boat dynamics. In addition, any disruption of water flow or additional lift at the stern ahead of the engine steering footprint can cause severe handling anomalies. Thus an independently operable trim tab mounted ahead of the engine's primary hydrodynamic control features is not recommended.

The jack plate or elevator style outboard motor lift, of which there are numerous examples in the art and on the market, is an efficient solution for reducing outboard motor gear case drag and draft. This lift does so by elevating the outboard motor relative to the boat's keel line. However, this style bracket in conjunction with an outboard motor is generally less effective at helping lift the vessel's stern, and does not typically enable significant improvement in vessel visibility and low speed fuel economy. The additional outboard motor setback these lifts provide can in some cases cause a reduction in visibility. Examples of this type of mounting system can be found in U.S. Pat. Nos. 8,627,779; 5,782,662; and 6,890,227.

BRIEF SUMMARY

The present disclosure provides an apparatus that enables varying and increasing the lift created on the transoms of outboard powered boats based on operating conditions, while minimizing disrupting of water flow to the propeller, thus maximizing forward thrust and control. The outboard motor mounting apparatus augments an outboard motor's trim range so that the operator or electronic controller may increase stern lift and propeller thrust in concert so as to reduce a vessel's time to plane, fuel burn, bow rise, increase boat speed, and improve visibility.

In accordance with one aspect of the present disclosure, an outboard motor mounting apparatus for controlling the outboard motor propeller thrust line angle of attack in addition to the range currently available in practice today is provided. In accordance with a further aspect a method for deploying afterplanes (hydrodynamic lifting surfaces) in order to create boat stern lift is provided, the afterplanes moving to provide lift with a trimmable hinged portion either alone or in combination with movement of the outboard motor propeller thrust line.

In accordance with another aspect of the present disclosure, an outboard motor mounting apparatus is provided that includes a first pair of mounts comprising first mounts, each first mount having a body, a pair of legs extending from the body, and an arm extending from the body, the arm having an elongate opening, a second pair of mounts comprising second mounts, each second mount having a body, a pair of legs extending from the body and configured to be pivotally mounted to the pair of legs on the first mounts to enable the first and second pairs of mounts to pivot with respect to each other, the second mounts further including an arm extending from the body and having an elongate opening, and a coupling assembly configured to couple the arms of the first pair of mounts to the arms of the second pair of mounts so that the elongate openings in the arms of the first and second pair of mounts at least partially overlap and to enable the arms of the second pair of mounts to slide relative to the arms of the first pair of mounts in response to movement of the second pair of mounts relative to the first pair of mounts that is in the range of +10° to −15° in which 0° represents the first pair of mounts in a parallel orientation to the second pair of mounts, +10° represents the arms on the second pair of mounts closer in proximity to the arms on the first pair of mounts, and −15° represents the arms on the second pair of mounts farther in proximity from the arms on the first pair of mounts.

In accordance with another aspect of the present disclosure, first and second afterplanes are provided that are configured to attach to the second pair of mounts adjacent the pair of legs respectively. Alternatively, the afterplane is configured to extend from the second pair of mounts adjacent the pair of legs and may be integrally formed therewith.

In accordance with one aspect of the present disclosure, an assembly is configured to provide increased engine trim on a boat having a transom and an outboard engine, the assembly including a first mounting plate configured for attachment to the transom and having a body with first and second opposing edges, at least two legs extending adjacent the first edge of the body and at least one arm extending adjacent the opposing second edge of the body, the at least one arm having an elongate opening, a second mounting plate configured for attachment to the engine and having a body with opposing first and second edges, at least two legs extending adjacent the first edge of the body and at least one arm extending adjacent the opposing second edge of the body, the at least one arm having an elongate opening, an axle configured to extend through the at least two legs of the first mounting plate and the at least two legs of the second mounting plate to enable pivotal movement of the second mounting plate relative to the first mounting plate; and a coupling configured to extend through the elongate openings in the arms of the first and second mounting plates and configured to cooperate with the elongate openings to enable the second edge of the second mounting plate to move toward and away from the second edge of the first mounting plate and thereby alter the trim of the engine relative to the transom of the boat.

In accordance with one aspect of the present disclosure, a vessel is provided that includes a transom, and an outboard propulsion mounting apparatus configured for attachment to the transom of the vessel, the outboard motor mounting apparatus including a first mounting plate configured for attachment to the transom and having a body with first and second opposing edges, at least two legs extending adjacent the first edge of the body and at least one arm extending adjacent the opposing second edge of the body, the at least one arm having an elongate opening, a second mounting plate configured for attachment to the engine and having a body with opposing first and second edges, at least two legs extending adjacent the first edge of the body and at least one arm extending adjacent the opposing second edge of the body, the at least one arm having an elongate opening, an axle extending through the at least two legs of the first mounting plate and the at least two legs of the second mounting plate to enable pivotal movement of the second mounting plate relative to the first mounting plate, and a coupling configured to extend through the elongate openings in the arms of the first and second mounting plates and configured to cooperate with the elongate openings to enable the second edge of the second mounting plate to move toward and away from the second edge of the first mounting plate and thereby alter the trim of the engine relative to the transom of the boat.

In accordance with yet a further aspect of the present disclosure, an outboard motor for use with a vessel having a transom is provided that includes an outboard motor trim adjustment and mounting bracket, and an outboard propulsion mounting apparatus configured for attachment to the transom of the vessel, the outboard motor mounting apparatus including a first mounting plate having a body with first and second opposing edges, at least two legs extending adjacent the first edge of the body and at least one arm extending adjacent the opposing second edge of the body, the at least one arm having an elongate opening, a second mounting plate having a body with opposing first and second edges, at least two legs extending adjacent the first edge of the body and at least one arm extending adjacent the opposing second edge of the body, the at least one arm having an elongate opening, an axle extending through the at least two legs of the first mounting plate and the at least two legs of the second mounting plate to enable pivotal movement of the second mounting plate relative to the first mounting plate, and a coupling configured to extend through the elongate openings in the arms of the first and second mounting plates and configured to cooperate with the elongate openings to enable the second edge of the second mounting plate to move toward and away from the second edge of the first mounting plate.

The design of the present disclosure benefits the recreational, commercial and government boat operator in the following ways:

(a) It creates an increased planing moment resulting in improved visibility, reduced vessel slamming loads, and when operated within reason, reduced operator whole body motion (WBM);

(b) Depending on boat type, it can reduce overall drag in a variety of operating regimes resulting in increased fuel economy and boat speed; and (d) It provides the operator with better visibility, running at whatever speed the mission requires.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with watercraft hulls and transoms, outboard motors, control systems, computers and microprocessor, and sensors have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

It is to be understood that the terms "marine vessel," "vessel," "boat," and "watercraft" are intended to be synonymous when used in this disclosure. While the present disclosure will be described in the context of an outboard motor mounted to the transom of a boat, the present disclosure will have application to a variety of outboard motor propelled watercraft including without limitation utility boats, fishing boats, runabouts, bow riders, dinghies, and all types of hulls including catamaran hulls, displacement and planing hulls, as well as types of materials, including wood boats, fiberglass boats, aluminum boats, rigid inflatable, and inflatable boats. It will be further understood that the term "outboard motor" is intended to include "engines" of various fuel types, electric motors, and other propulsion means currently known that can be mounted to the transom of a watercraft and drive a propeller or impellor to generate thrust for the watercraft.

Figure 1:
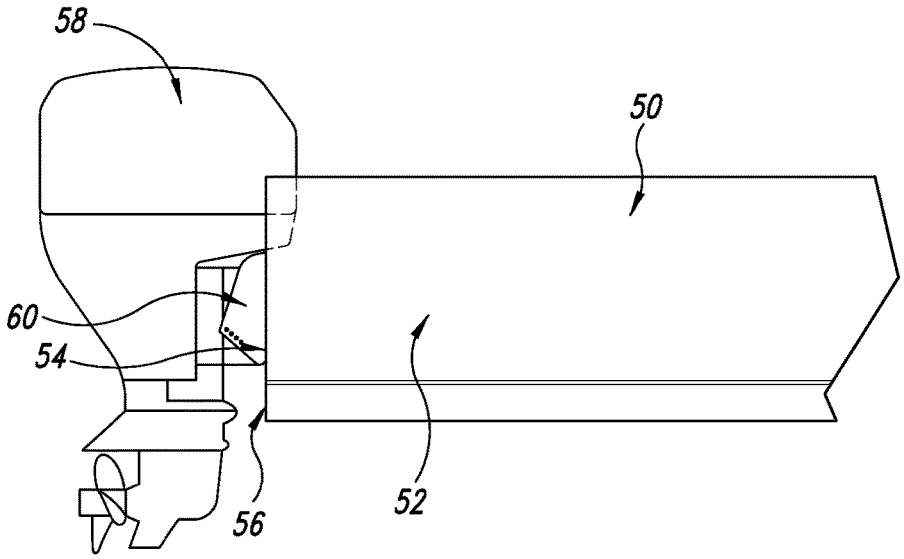
FIG. 1 (Prior Art)
FIG. 1 is an illustration of a known watercraft having an outboard motor.
Figure 2:
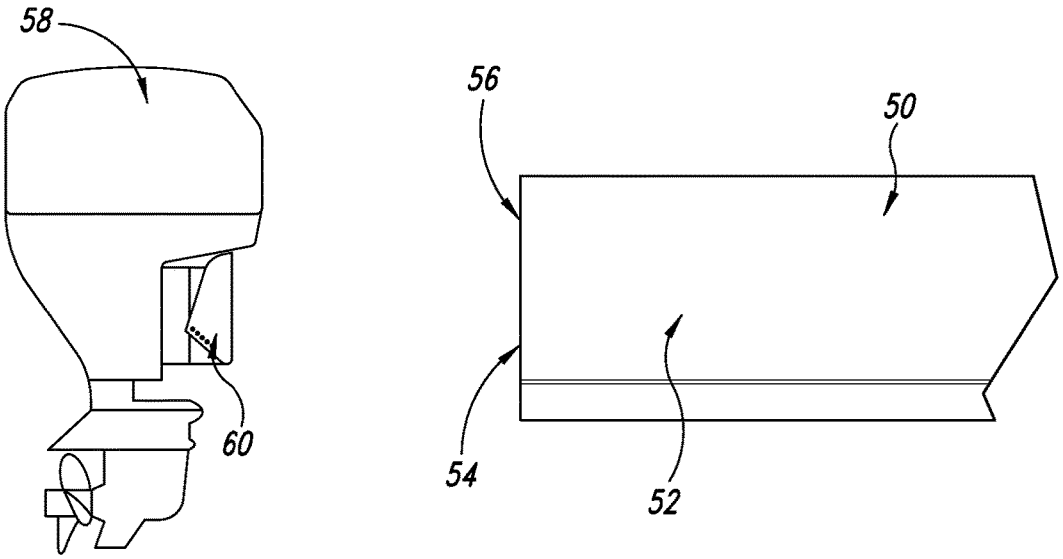
FIG. 2 (Prior Art)
FIG. 2 is an exploded view of the watercraft of FIG. 1.
Figure 3:
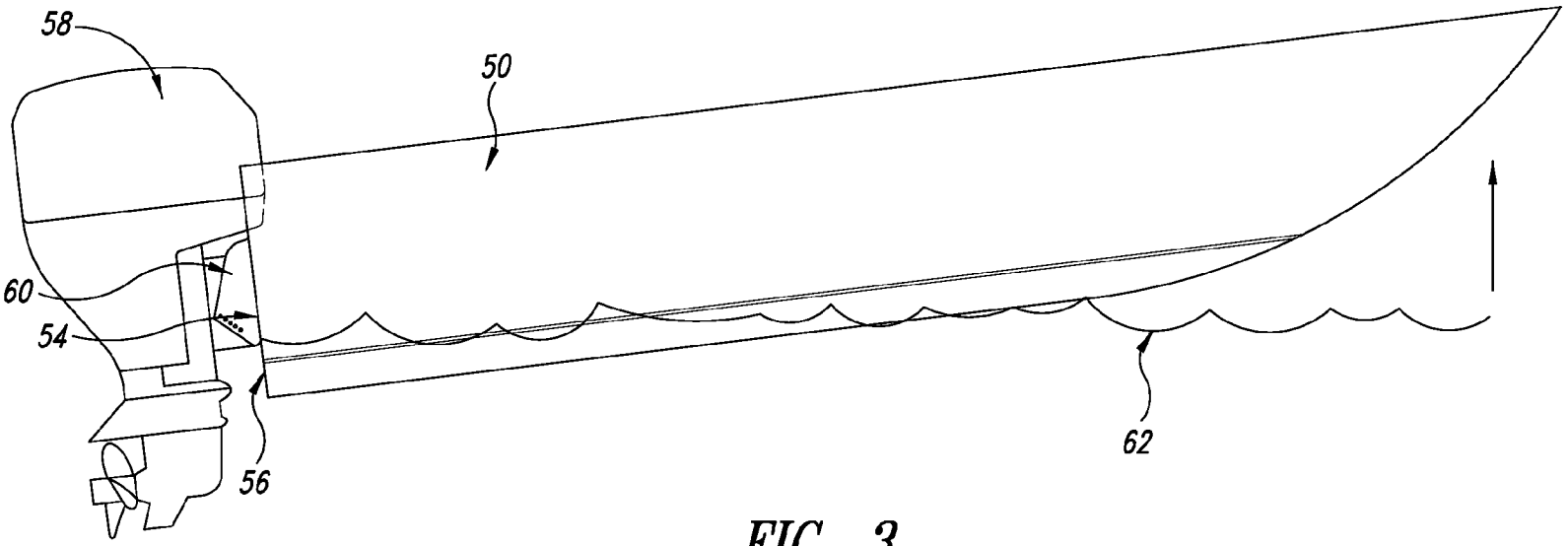
FIG. 3 (Prior Art)
FIG. 3 is an illustration of the watercraft in an untrimmed, bow high condition according to current technology.
Figure 4:
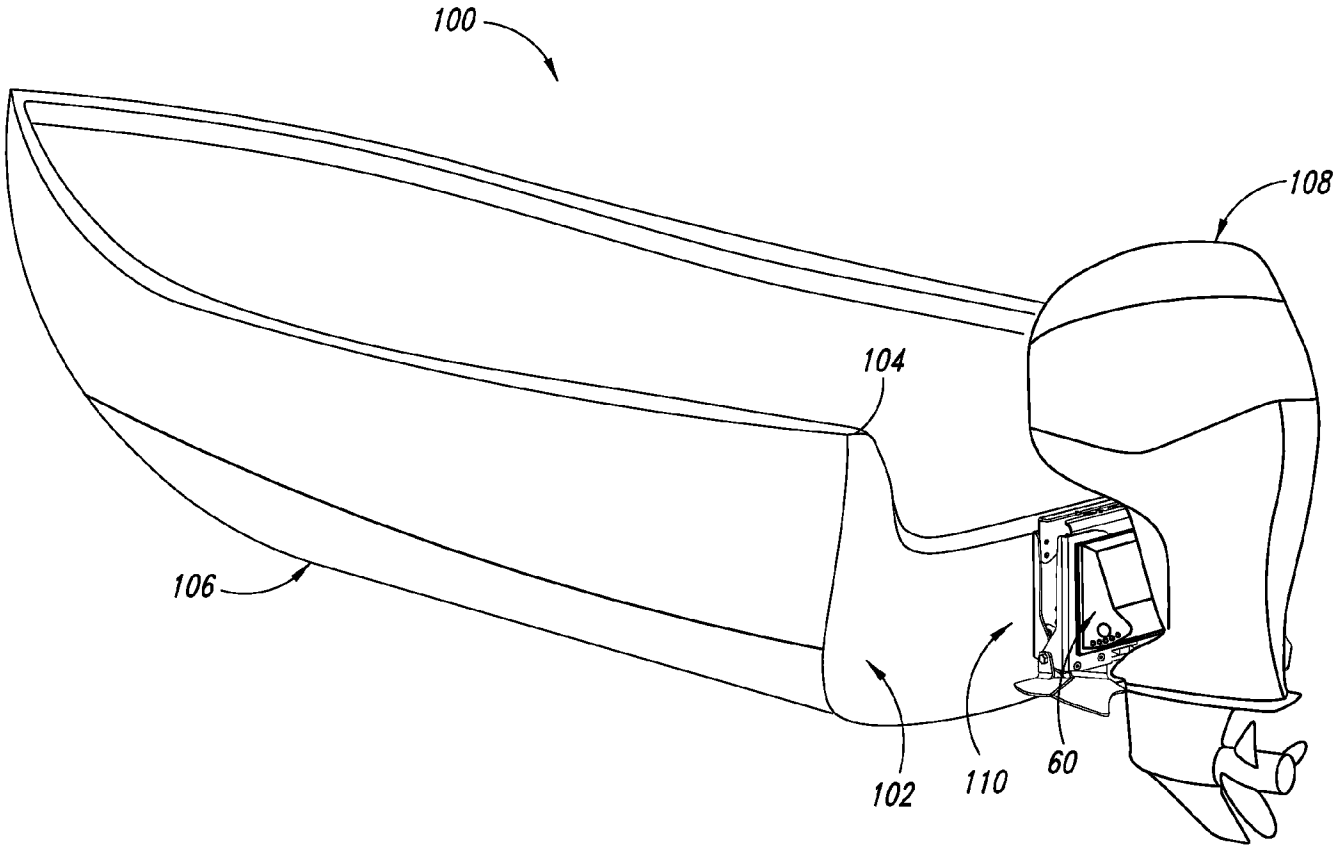
FIG. 4 is an illustration of a watercraft having an outboard motor mounted thereto using a mounting apparatus formed in accordance with the present disclosure.
Figure 5:
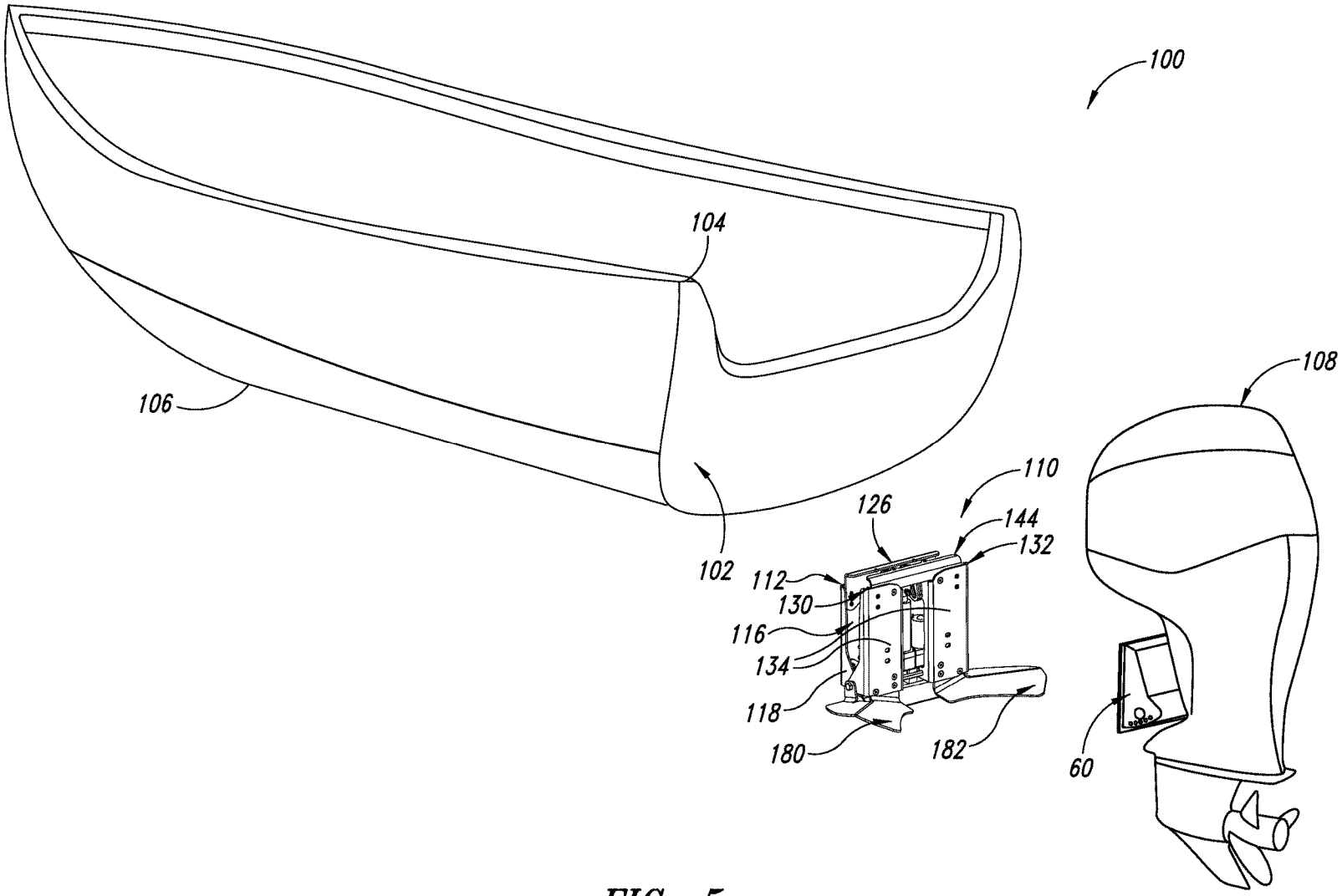
FIG. 5 is an exploded illustration of the watercraft, mounting apparatus, and outboard motor of FIG. 4.
Figure 6:
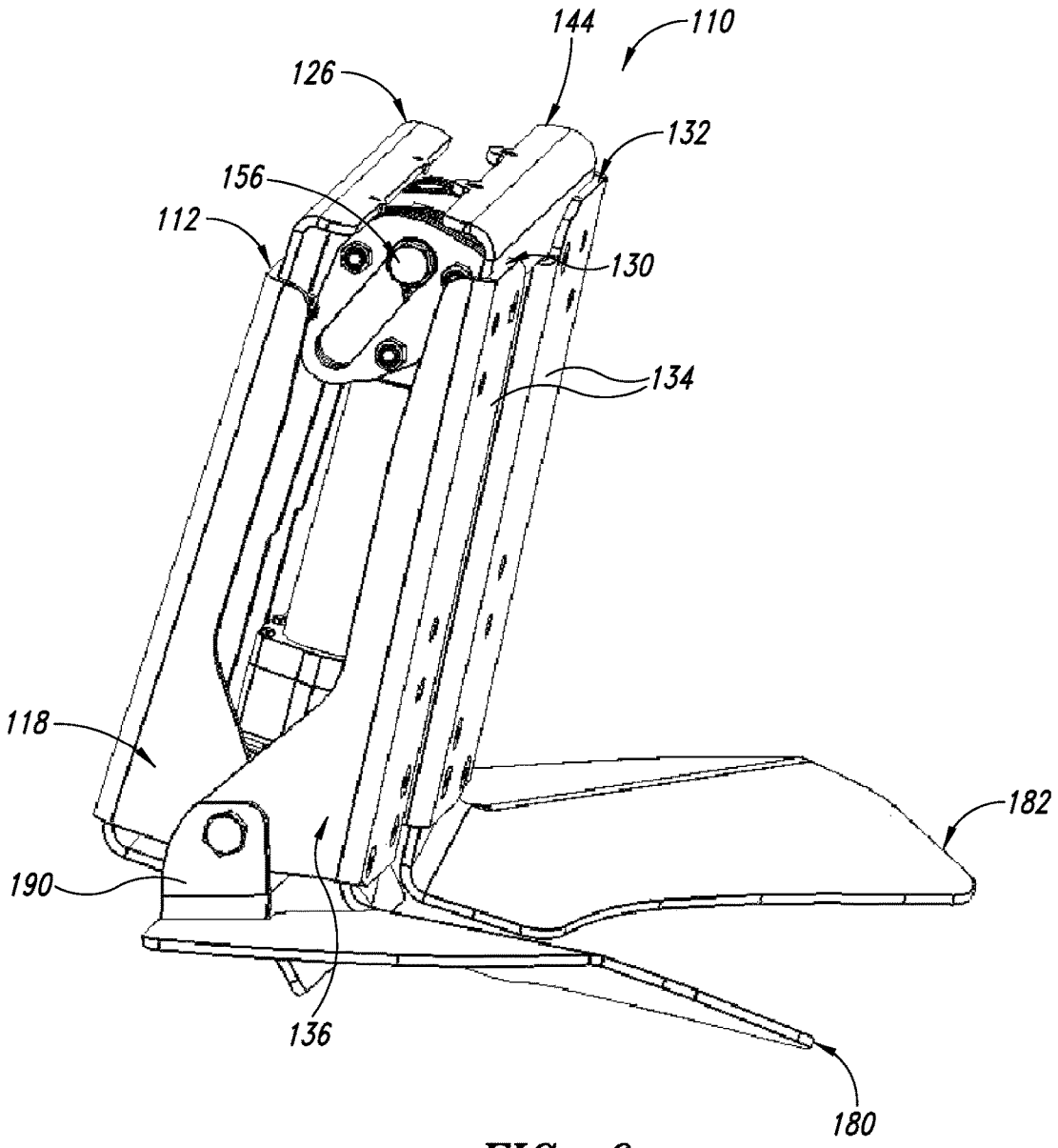
FIG. 6 is an axonometric view of the mounting apparatus formed in accordance with the present disclosure in a fully retracted configuration.
Figure 7:
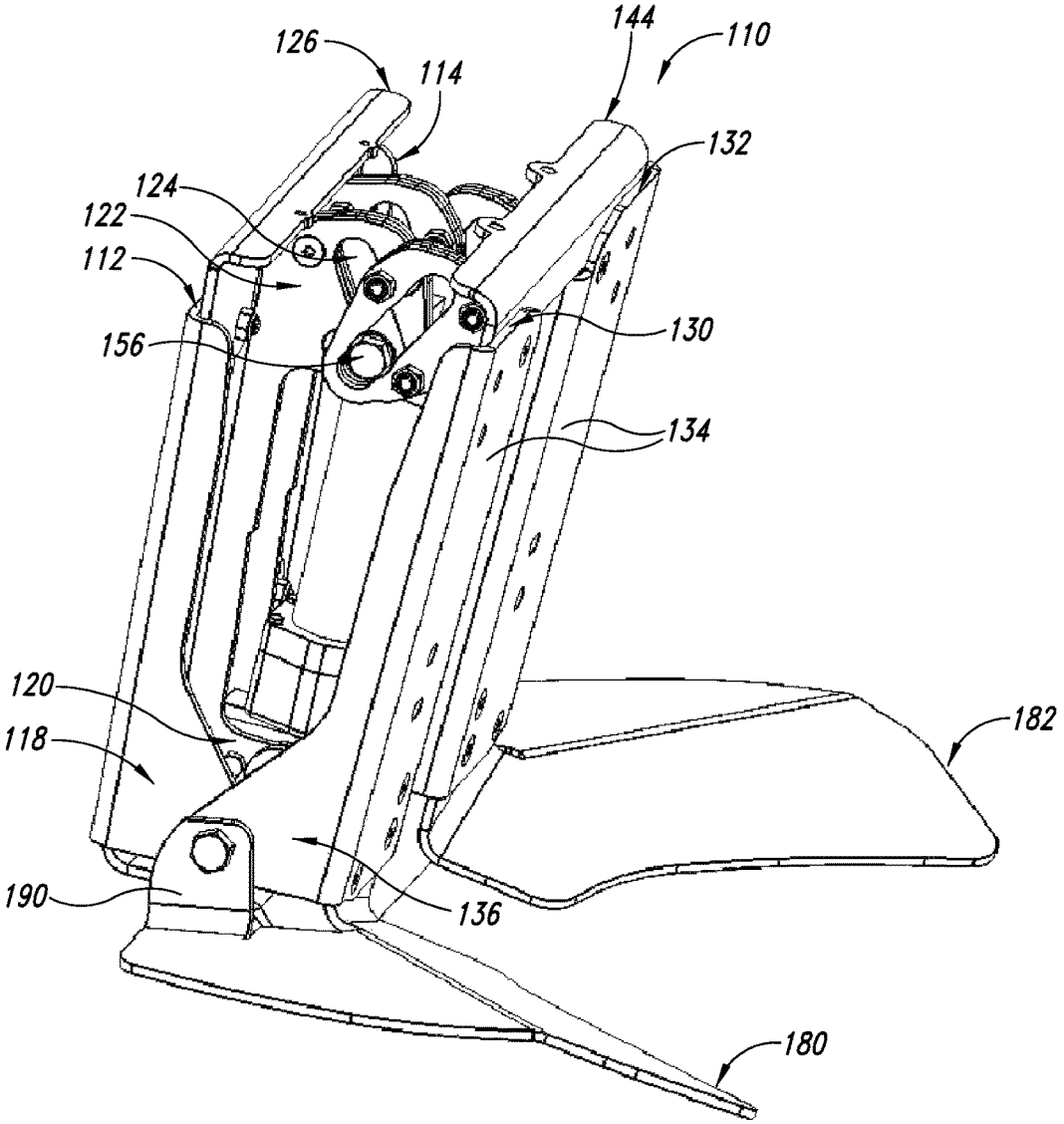
FIG. 7 is an axonometric view of the mounting apparatus formed in accordance with the present disclosure in a fully extended configuration.
Figure 8:
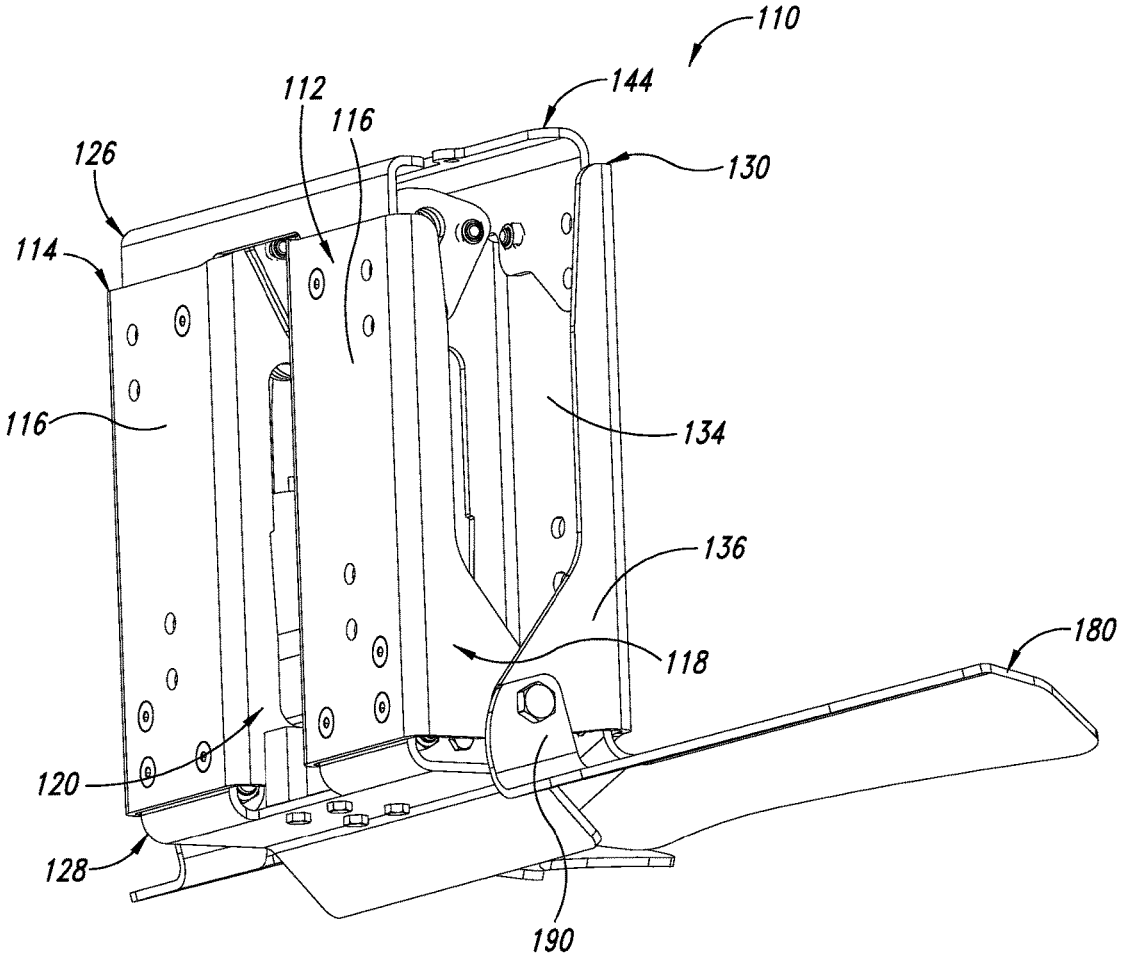
FIG. 8 is a lower right side axonometric view of the mounting apparatus of FIG. 6.
Figure 9:
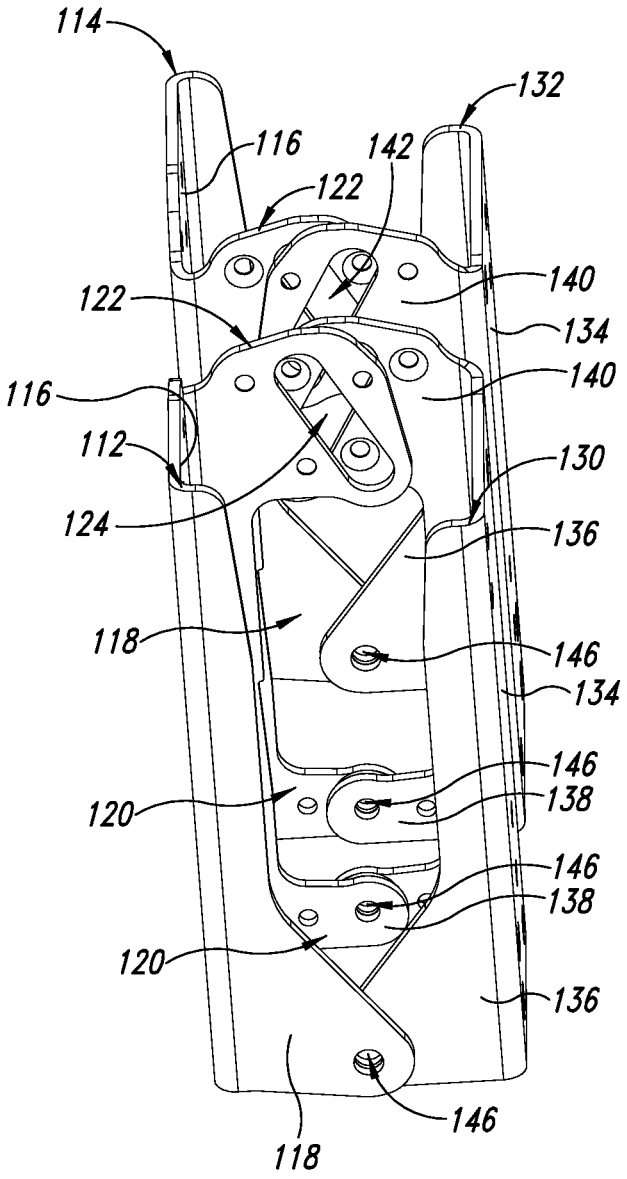
FIG. 9 is an axonometric view of the first pair of mounts and the second pair of mounts for the mounting apparatus formed in accordance with the present disclosure.

Referring initially to FIGS. 4 and 5, a vessel or watercraft in the form of a boat 100 is shown that includes a transom 102 at a stern 104 of the boat hull 106. An outboard motor 108 is shown attached to the stern 104 by a propulsion mounting apparatus 110 configured for attachment to the transom 104 of the boat 100. An integral mounting bracket 60 interfaces the outboard motor mounting apparatus 110 to the outboard motor 108, which is described above in conjunction with FIGS. 1 and 2.

Referring next to FIGS. 6-9, shown therein is the outboard motor mounting apparatus 110, which includes a first pair of mounts consisting of first mounts 112, 114, each first mount 112, 114 having a body 116, a pair of legs 118, 120 extending from a lower portion of the body 116, and an arm 122 extending from an upper portion of the body 116, the arm 122 having an elongate opening 124. The first pair of mounts 112, 114 are preferably mirror images of each other and are configured to attach to the transom 104 of the boat 100 using conventional fastening means such as bolts and nuts, which will not be described in detail herein.

A second pair of mounts consisting of second mounts 130, 132 is also provided for attachment to the outboard motor 108. Each second mount 130, 132 has a body 134, a pair of legs 136, 138 extending from a lower portion of the body 134 and configured to be pivotally mounted to the pair of legs 118, 120 on the first mounts 112, 114 to enable the first and second pairs of mounts 112, 114, 130, 132 to pivot with respect to each other. Suitable fasteners are used to connect the legs together as shown in the figures to enable pivotal movement of the mounts as will be described in more detail herein. A lower transverse member 128 can be used to bridge across the bottom of the first pair of mounts 112, 114. The lower transverse member 128 can include an a lateral plate extending from an aft edge of the lower transverse member 128 and angled away from the first and second pairs of mounts 112, 114, 120, 132 as shown. The lateral plate can be integrally formed with the lower transverse member 128.

The second mounts 130, 132 further include an arm 140 extending from the body 134 and having an elongate opening 142. Preferably the second mounts 130, 132 are mirror images of each other. More preferably, the second mounts 130, 132 have the same size and shape as the first mounts 112, 114 so as to be interchangeable with their respective copy. It will be appreciated that this design will facilitate the manufacture and assembly of the mounting apparatus 110. Ideally, each leg 118, 120, 136, 138 of the first and second mounts 112, 114, 130, 132 has an opening 146 through which a fastener is placed and which acts as an axle about which the second mounts 130, 132 pivot with respect to the first mounts 112, 114.

A coupling assembly 150 is configured to couple the arms 122 of the first pair of mounts 112, 114 to the arms 140 of the second pair of mounts 130, 132 so that the elongate openings 124, 142 in the respective arms 122, 140 of the first and second pair of mounts at least partially overlap and to enable the arms 140 of the second pair of mounts 130, 132 to slide relative to the arms 122 of the first pair of mounts 112, 114 in response to movement of the second pair of mounts 130, 132 relative to the first pair of mounts 112, 114. Ideally, that movement is in the range of +10° to −15° in which 0° represents the first pair of mounts 112, 114 in a parallel orientation to the second pair of mounts 130, 132, +10° represents the arms 140 on the second pair of mounts 130, 132 closer in proximity to the arms 122 on the first pair of mounts 112, 114, and −15° represents the arms 140 on the second pair of mounts 130, 132 farther in proximity from the arms 122 on the first pair of mounts 112, 114 while the arms remain in an overlapping relationship throughout the movement.

The elongate opening 124 in the arms 122 of the first pair of mounts 112, 114 has a longitudinal axis at a first orientation and the elongate opening 142 in the arms 140 of the second pair of mounts 130, 132 has a longitudinal axis at a second orientation that intersects the longitudinal axis of the elongate opening 124 in the arms 122 of the first pair of mounts 112, 114 when the first pair of mounts 112, 114 are pivotally attached at their legs 118, 120 to the legs 136, 138 of the second pair of mounts 130, 132, and the coupling assembly 150 couples the arms 122 of the first pair of mounts 112, 114 to the arms 140 of the second pair of mounts 130, 132 in a slidable arrangement.

Figure 10:
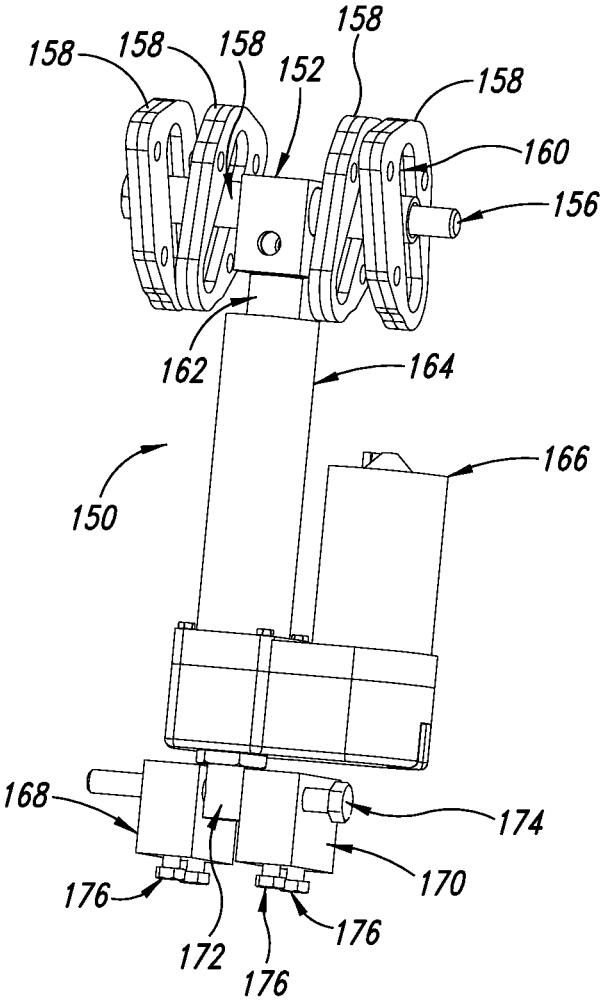
FIG. 10 is an axonometric view of the coupling assembly with actuator assembly formed in accordance with the present disclosure.

FIG. 10 illustrates the coupling assembly 150 in more detail. As shown therein, the coupling assembly 150 includes a yoke 152 in the shape of a rectangular or square block having a lateral bore (not shown) from which tubular spacers 154 extend laterally therefrom. These spacers 154 provide separation and act as bearings that ride within the elongate openings 124, 142 of the arms 122, 140 of the first and second mounts 112, 114, 130, 132. Extending through the spacers 154 and the yoke 152 is a bolt 156 used to secure the yoke 152 and spacers 154 to the arms 122, 140. Also shown are four doubler plates 158 that are mounted on each side of the arms 122, 140 to provide additional strength for load bearing. Each doubler plate 158 has an elongate opening 160, which is sized and shaped to match the elongate openings 124, 142 in the arms 122, 140, as well as additional openings for use with fasteners (not shown) to attach the doubler plate 168 to the respective arm 122, 140.

Extending into the bottom of the yoke 152 is a rod 162 that is located within a housing 164 that in turn is mounted on an electric actuator assembly 166. This actuator assembly 166 is readily commercially available and will not be described in detail herein. Briefly, the actuator assembly includes an electric motor that moves the rod 162 into and out of the housing 164. When the rod is retracted from the housing, it moves the yoke 152 and spacers 154 away from the actuator assembly 166. The spacers 154 in turn ride upward within the elongate openings 160 of the doubler plates 158 as well as the associated elongate openings 124, 142 in the arms 122, 140 of the first and second mounts 112, 114, 130, 132. This in turn forces the second mounts 130, 132 to pivot about the lower mounting point opening 146 and move towards the first mounts 112, 114 as the arms in the second mounts 130, 132, move towards the arms 122 in the first mounts 112, 114. This is the retracted position shown in FIG. 6.

Similarly, when the actuator assembly 166 moves the rod 162 to retract into the housing 164, it moves the yoke 152 and spacers 154 towards the actuator assembly 166. The spacers 154 in turn ride downward within the elongate openings 160 of the doubler plates 158 as well as the associated elongate openings 124, 142 in the arms 122, 140 of the first and second mounts 112, 114, 130, 132. This in turn forces the second mounts 130, 132 to pivot about the lower mounting point opening 146 and move away from the first mounts 112, 114 as the arms in the second mounts 130, 132, move away from the arms 122 in the first mounts 112, 114. This is the extended position shown in FIG. 7.

The coupling assembly 150 further includes first and second transfer plates 168, 170 pivotally attached to a post 172 extending from the bottom of the actuator assembly 166 by a fastener 174, in this case a bolt. Fasteners 176 extending from the bottom of the first and second transfer plates 168, 170 are used to attach the first and second transfer plates 168, 170 to the lower transverse member 128.

Figure 11:
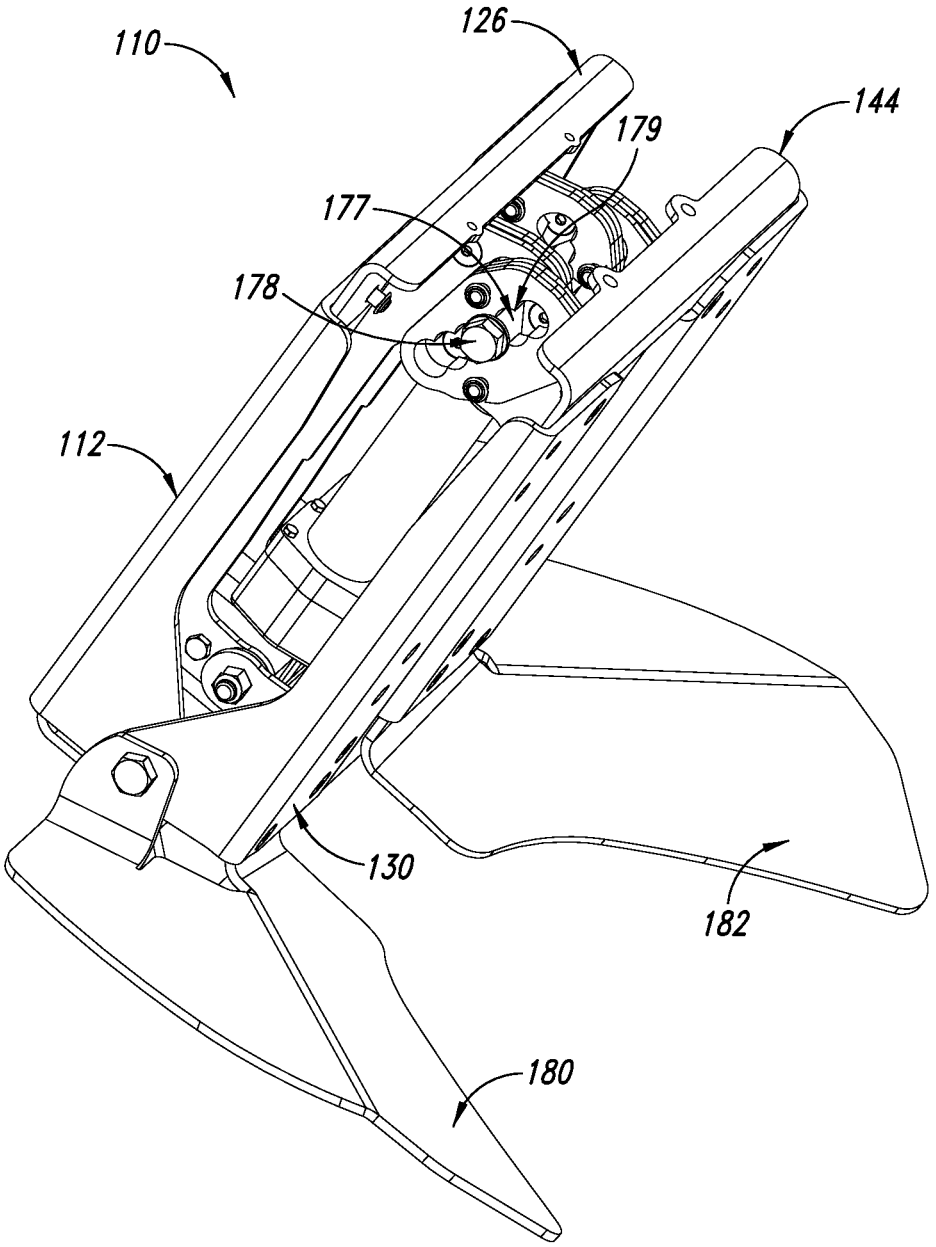
FIG. 11 is an axonometric view of an alternative implementation of the mounting assembly for selected fixed orientations in accordance with the present disclosure.

If it is desired to fix the outboard motor mounting apparatus 110 at one position, a fixative bolt 178 can be used as shown in FIG. 11, which passes through the elongate openings 124 in the arms 122 of the first pair of mounts 112, 114 and the elongate openings 142 in the arms 140 of the second pair of mounts 130, 132 to mechanically fix the outboard motor mounting apparatus 110 at a predetermined angle between +10° to −15°. As shown in this implementation, the elongate openings 177 are occluded and have detents 179 formed thereon to hold the first and second mounts 112, 114, 130, 132 at predetermined fixed positions. In this case there are four settings, although more or less settings may be formed as desired, limited by the elongate length of the opening 177. It will be appreciated that instead of the elongate opening, a single opening may be used that is sized to receive a single fastener, thus fixing the mounting apparatus 110 at only one angle of orientation.

Turning back to FIGS. 6-9, at least one upper transverse member 144 is configured to attach to the second pair of mounts 130, 132 to bridge across the top of the second pair of mounts 130, 132 and enable the second pair of mounts 130, 132 to move in unison with respect to the first pair of mounts 112, 114. An upper transverse member 126 can be used to bridge the top of the first pair of mounts 112, 114. Each of the transverse members 126, 128, 144 is preferably attached with suitable fasteners to the body 116, 134 of the respective first and second mounts 112, 114, 130, 132.

Figure 12:
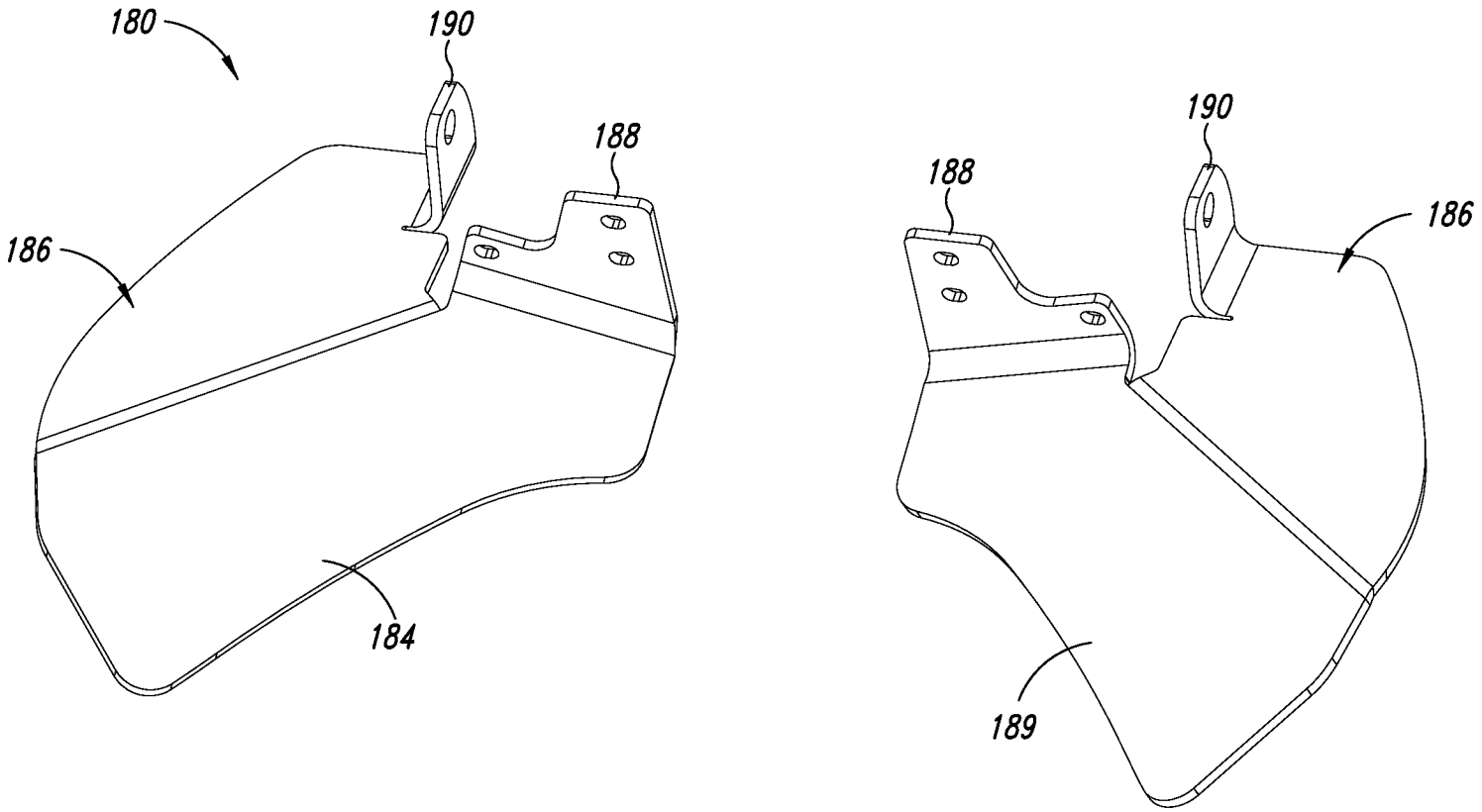
FIG. 12 is an axonometric illustration of the left and right afterplanes formed in accordance with the present disclosure.

In accordance with a preferred implementation of the present disclosure, first and second afterplanes 180, 182 are configured to attach to the second pair of mounts 130, 132 adjacent the pair of legs 136, 138 respectively. As shown more clearly in FIG. 12, each afterplane 180, 182 includes a plane body 184 and a lateral wing 186 integrally formed with and extending from the plane body 186. A first bracket 188 extends from the main plane body 184 and a second bracket extends from the lateral wing 186. The first bracket is configured for attachment to the body 134 of the respective second mount 130, 132. A second bracket 190 extends from the lateral wing 186 and is configured for attachment to the respective leg 136, 138 of the respective second mount 130, 132, preferably at the opening 146 with the fastener that functions as the axle as described above. This version of the afterplanes 180, 182 and geometry is not commercially available and is designed to mount, move with, and provide an integral function in the disclosed implementations of the present disclosure.

Alternatively, the afterplanes 180, 182 are integrally formed with and configured to extend from the respective second pair of mounts 130, 132 adjacent the pair of legs 136, 138.

In accordance with a further alternative implementation, the afterplanes can be mounted to the lower transverse member 128 to extend from the lower transverse member 128 or they may be integrally formed with the lower transverse member 128.

Figure 13:
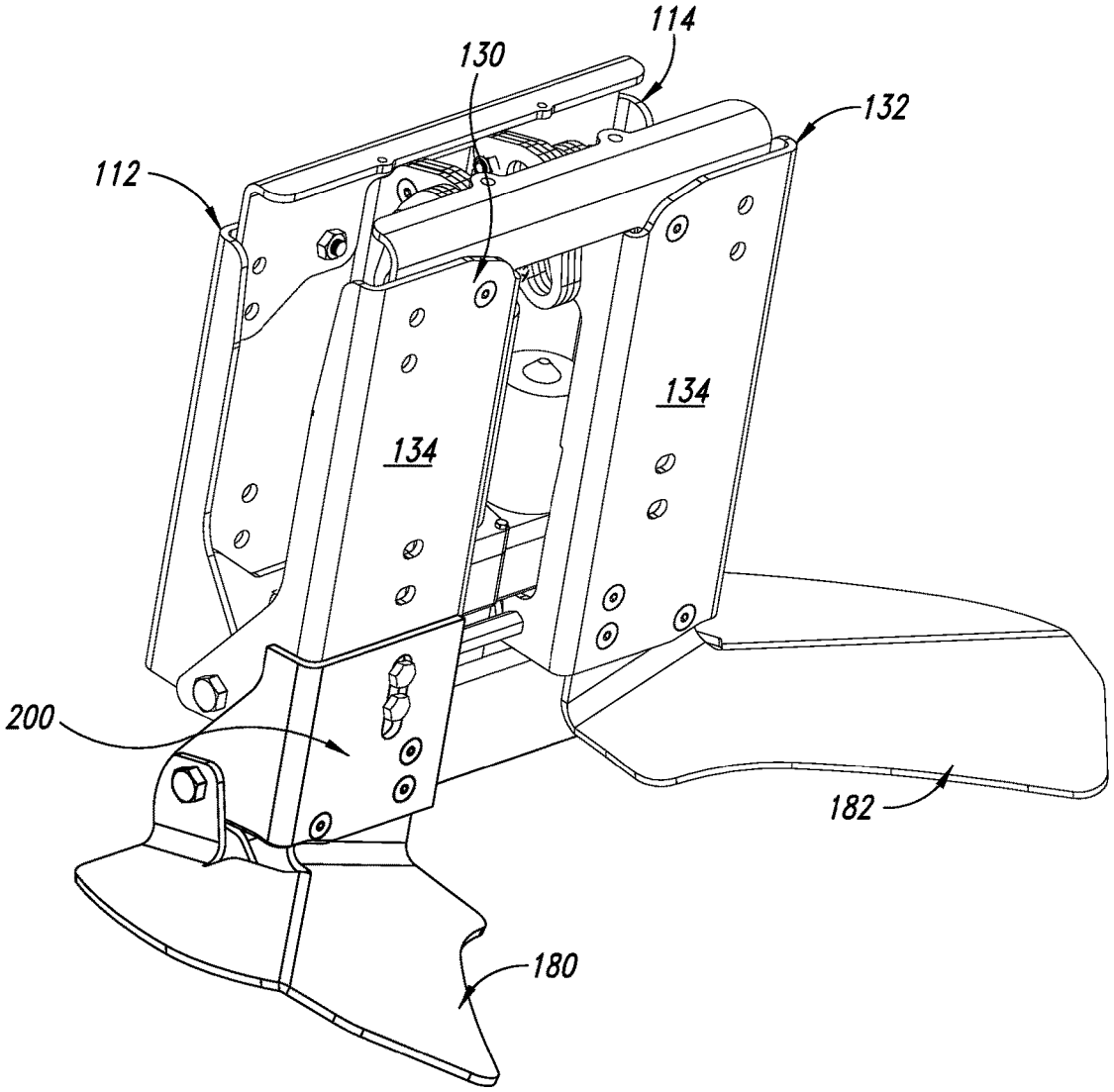
FIG. 13 is an axonometric view of an alternative implementation of the mounting assembly of the present disclosure to include an afterplane extension.

In some installations a vertical downward translation of the afterplanes 180, 182 is desired to accommodate hull transom or engine characteristics. An afterplane extension 200 is shown in FIG. 13 that mounts to the outboard motor side of the lower portion of each second mount 130, 132 and is configured to translate the afterplanes 180, 182 downward to the degree that the boat transom height increment and outboard motor dictates. It is to be understood there would be two extensions 200, one for each second mount 130, 132. The afterplanes 180, 182 attach to the extension 200 using the existing brackets 188, 190.

Figure 14A:
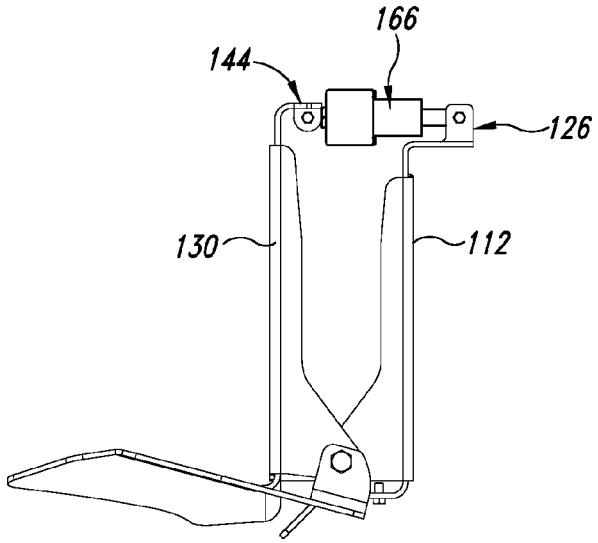
FIGS. 14A and 14B illustrate an alternative implementation of the mounting apparatus in accordance with the present disclosure where the actuation assembly is in a horizontal orientation.
Figure 14B:
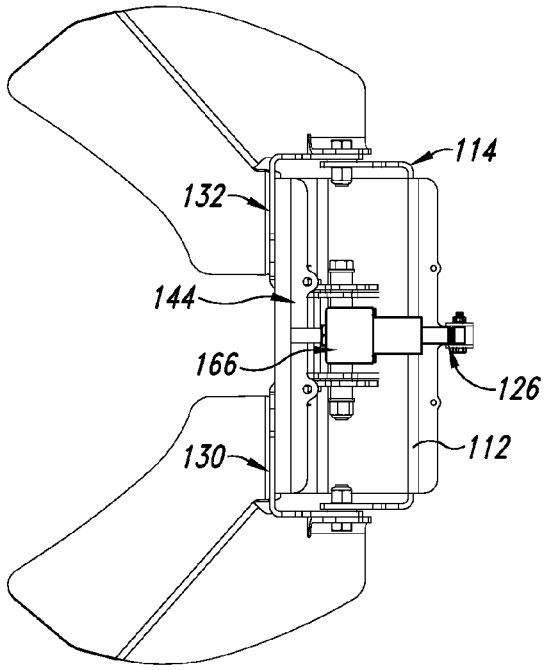

FIGS. 14A and 14B illustrate an alternative implementation in which the coupling assembly is modified to use the actuator assembly 166 in a horizontal orientation. It is attached to the upper transverse member 126 at one end and to the second mounts 130, 132 on the other end.

Figure 15A:
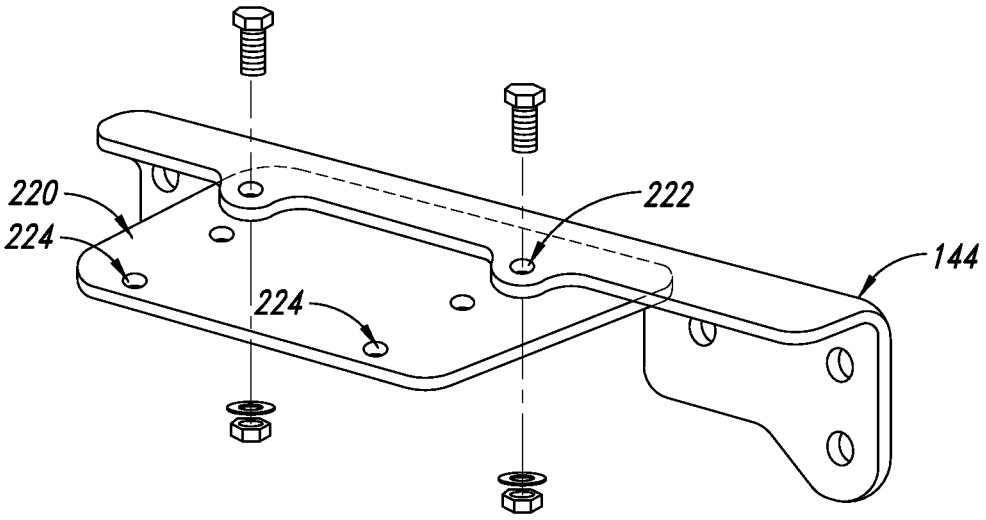
FIGS. 15A and 15B illustrate an alternative implementation of the mounting apparatus of the present disclosure to include a steering actuation system.
Figure 15B:
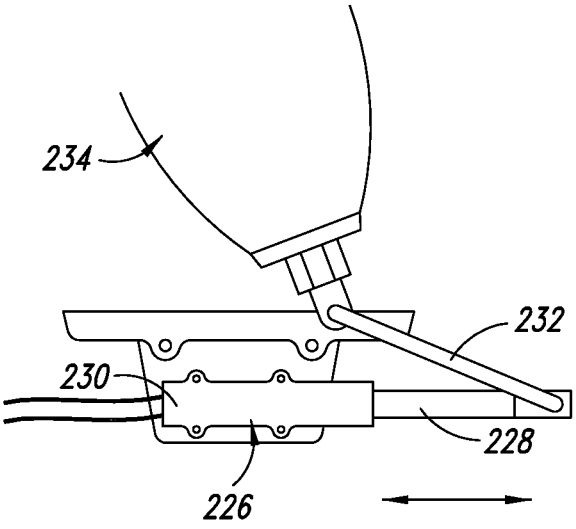

Referring next to FIGS. 15A and 15B, an optional steering plate 220 is provided for attachment to the upper transverse member 144 that attaches to the second pair of mounts 130, 132. The plate 220 is flat and has mounting holes not shown that align with holes 222 in the upper transverse member 144. Four additional holes 224 are provided for mounting a steering actuator (electric or hydraulic) 226 thereto. The actuator 226 has a rod 228 that extends and retracts from the actuator housing 230. A steering link 232 couples the rod 228 to an outboard motor 234. This feature provides for steering control for the implementation in which the actuator assembly 166 is mounted horizontally as described above.

In a second implementation, the outboard motor mounting apparatus 110 has the first pair of mounts 112, 114 formed as a single first mounting plate configured for attachment to the transom 102 and having a single body with first and second opposing edges, at least two legs extending adjacent the first edge of the body and at least one arm extending adjacent the opposing second edge of the body, the at least one arm having an elongate opening. The second pair of mounts 130, 132 are also configured as a single second mounting plate configured for attachment to the engine and having a body with opposing first and second edges, at least two legs extending adjacent the first edge of the body and at least one arm extending adjacent the opposing second edge of the body, the at least one arm having an elongate opening. An axle extends through the at least two legs of the first mounting plate and the at least two legs of the second mounting plate to enable pivotal movement of the second mounting plate relative to the first mounting plate.

A coupling assembly is configured to extend through the elongate openings in the arms of the first and second mounting plates and configured to cooperate with the elongate openings to enable the second edge of the second mounting plate to move toward and away from the second edge of the first mounting plate and thereby alter the trim of the outboard motor relative to the transom of the boat. An actuator is also provided with the coupling assembly to actuate movement of the second plate.

A control system for the actuator assembly 166 can be provided as known to those skilled in the art to enable a user to control the degree of outboard motor trim. The control system includes a plurality of sensors configured to generate sensing signals and a microprocessor electrically coupled to the actuator and the plurality of sensors and configured to receive the sensing signals from the plurality of sensors and to generate control signals to the actuator in response to the sensing signals.

The outboard motor 108 can be combined with the outboard motor mounting apparatus 110 described above or the alternative implementation immediately preceding this paragraph and sold as a unit for mounting on existing boats or new boats. New boats and used boats refurbished with the outboard motor mounting apparatus 110 or the alternative implementation can be combined with an outboard motor 108 and sold as a complete watercraft or system.

Figure 16:
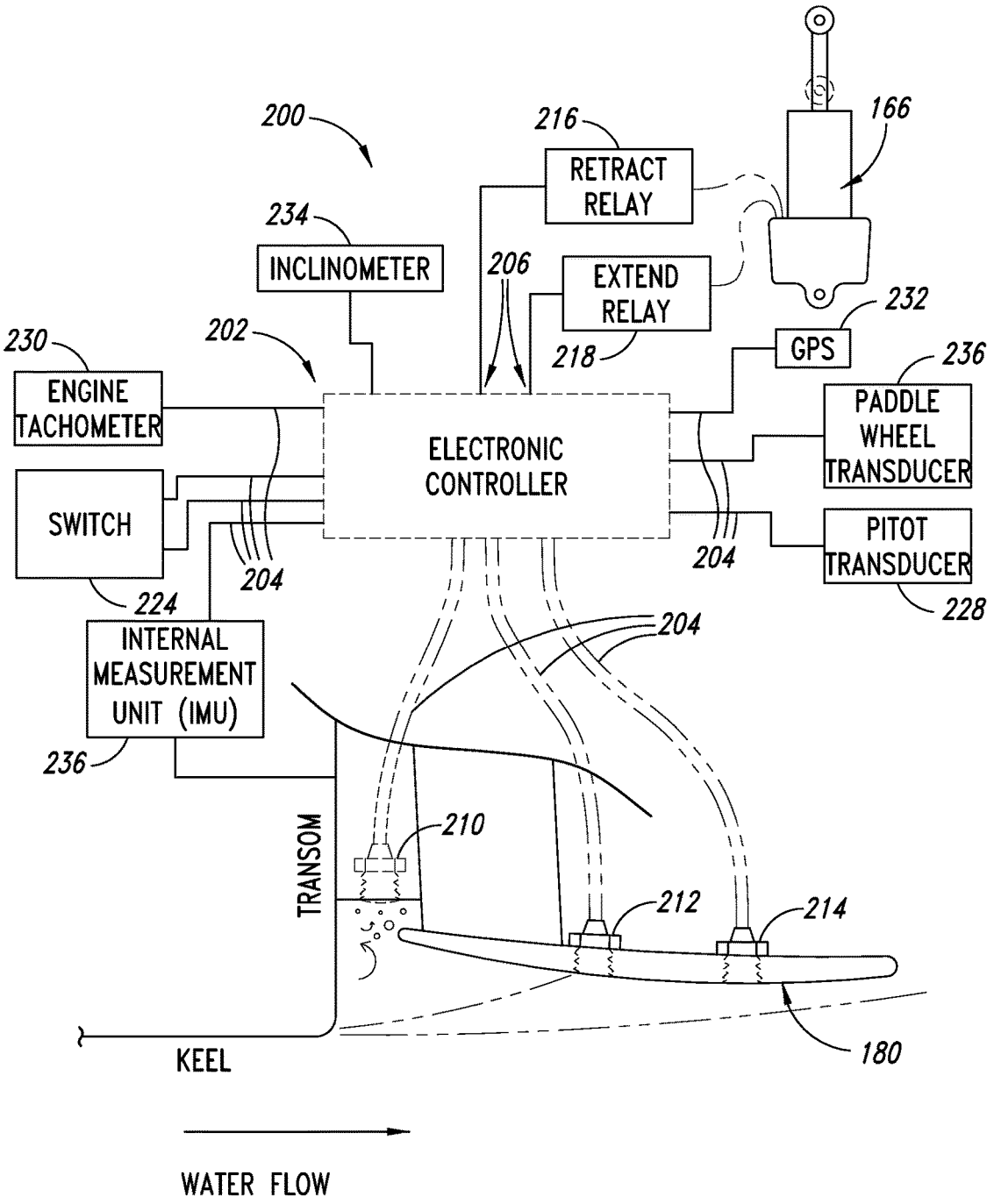
FIG. 16 illustrates a control system formed in accordance with the present disclosure.

FIG. 16 is a schematic view showing one implementation of a control system 200 for the boat 100 having the outboard motor mounting apparatus 110 attached thereto. The control system 200 includes an electronic controller 202 having a plurality of input terminals 204 coupled to a plurality of sensors (described below) and output terminals 206 coupled to the actuator assembly 166. In this scheme a harness connects a plurality of (water continuity) sensors 210, 212, 214 mounted on the outboard motor mounting apparatus 110 and on the afterplanes 180, 182. The electronic controller 202 has its output terminals 206 connected to a set of relays 216, 218 to control extension and retraction of the outboard motor mounting apparatus 110 via the actuator assembly 166. Alternately, the electronic controller 202 is configured to receive and respond to command inputs from an operator via an interface coupled to control inputs 220, 222 to extend or retract the mounting apparatus. A two-position momentary switch 224 can be used, which is mounted ergonomically, within easy reach of the boat steering wheel. The electronic controller 202 has additional inputs for a multitude of electronic, positional, analog, digital and hydrodynamic sensors such as a paddle wheel transducer input 226, a pitot transducer 228, an engine tachometer 230, a GPS 232, inclinometer 234, and an inertial measurement unit (IMU) 236, all of which are known and will not be described in detail herein.

The control system 200 receives commands from the user interface 224, the plurality of sensors configured to generate sensing signals 226, 228, 230, 232, 234, and 236, and a microprocessor in the electronic controller is configured to generate control signals to the actuator assembly 166 in response to the plurality of sensing signals and to inputs from the user interface 224.

Figure 17A:
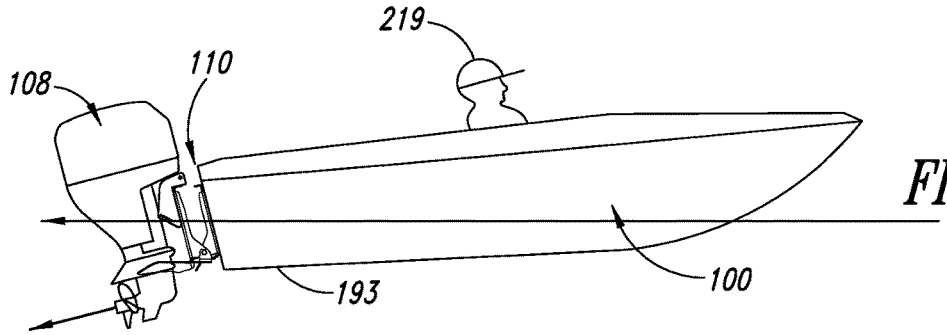
FIGS. 17A-17D are side plan views of the vessel of FIG. 4 with the mounting apparatus in different operating modes.
Figure 17B:
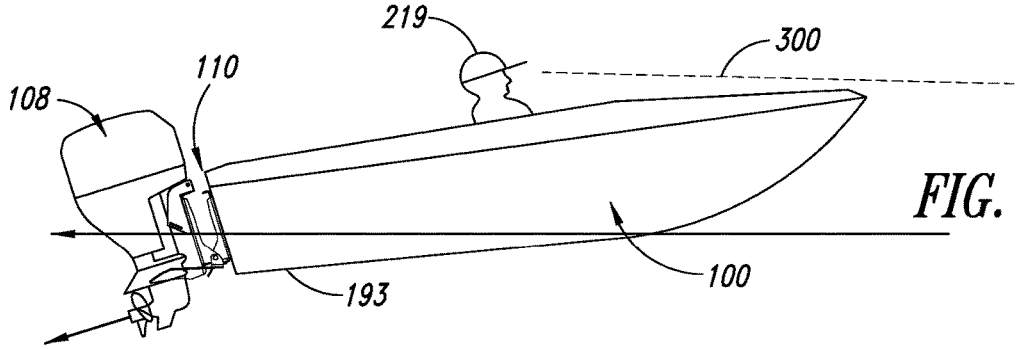
Figure 17C:
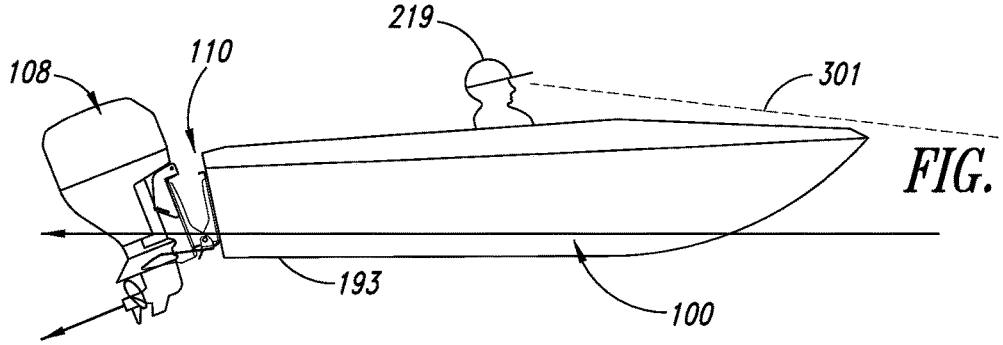
Figure 17D:
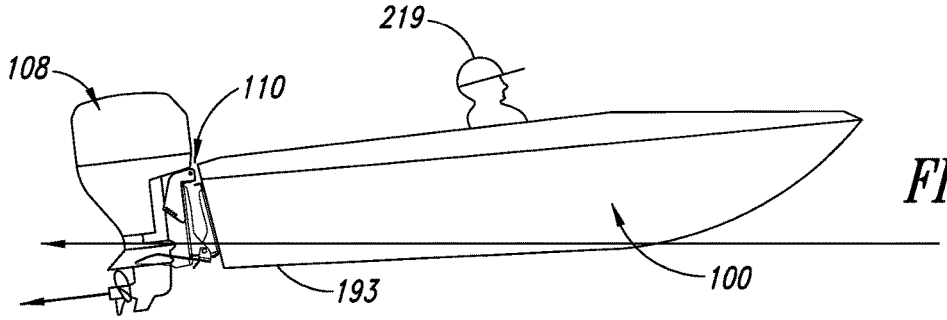

FIG. 17A shows the boat 100 floating in a displacement condition driven forward by the outboard motor 108 and the outboard motor mounting apparatus 110. Here the outboard motor mounting apparatus 110 is shown in a neutral position. In FIG. 17B, the boat 100 is in a low speed pre-planing condition driven forward by the outboard motor 108. The outboard motor mounting apparatus 110 is in a neutral position and the bow is in a typical pre-planing bow-high attitude where visibility can be obstructed ahead of the bow as shown by operator line-of-sight 300. FIG. 17C shows the boat 100 in a typical low speed pre-planing condition driven forward by the outboard motor 108 and the outboard motor mounting apparatus 110 has moved to the fully extended position causing the bow to drop for improved visibility as shown by operator-line-of sight 301 and increased boat wetted length which can result in improved ride quality. In FIG. 17D, the boat 100 is in a high speed condition driven forward by the outboard motor 108 and the outboard motor mounting apparatus 110 has moved to the fully retracted position helping lift the bow for reduced hull drag.

In operation, the user inputs commands via the interface device, such as the switch, to cause the outboard motor to change the angle of the propeller thrust line. As the second mounts move the outboard motor, they also move the afterplanes attached thereto, which adjusts the outboard motor trim as the boat moves through the water. This system allows the operator to keep the bow low during low speed and pre-planing operations, which is typically when the bow is at its highest point above the water, obstructing the operator's ability to see ahead of the watercraft.

As will be readily appreciated from the foregoing, the bolt-on chassis utilizing the outboard transom bracket of the present disclosure provides a number of benefits. This is the world's first outboard transom bracket designed to combine the benefits of an elevated engine thrust vector modified simultaneously with a pair of chassis mounted afterplanes. It is revolutionary because it simultaneously brings several positive boat set-up factors to one bolt-on chassis, capable of being operated through a single input. It provides increased engine trim, increased engine elevation, increased transom lift, and can increase system wetted length, which can reduce vessel slamming loads.

The various implementations described above can be combined to provide further implementations. Aspects of the implementations can be modified, if necessary to employ concepts of the various patents, applications and publications to provide yet further implementations.

U.S. Provisional Patent Application No. 61/966,572 filed Feb. 26, 2014, is incorporated herein by reference, in its entirety.

These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. An outboard motor mounting apparatus configured to provide increased outboard motor trim adjustment on a boat having a transom and an outboard motor, the outboard motor mounting apparatus comprising:

a first mounting plate configured for attachment to the transom and having a first body with a first edge and a second edge opposing the first edge, at least two legs extending adjacent the first edge of the first body and at least one arm extending adjacent the opposing second edge of the first body, the at least one arm having a first elongate opening;

a second mounting plate configured for attachment to the outboard motor and having a second body with a first edge and a second edge opposing the first edge, at least two legs extending adjacent the first edge of the second body and at least one arm extending adjacent the opposing second edge of the second body, the at least one arm having a second elongate opening;

an axle configured to extend through the at least two legs of the first mounting plate and the at least two legs of the second mounting plate to enable pivotal movement of the second mounting plate relative to the first mounting plate; and a coupling configured to extend through the elongate openings in the at least one arm of the first and second mounting plates and configured to cooperate with the first and second elongate openings to enable the second edge of the second mounting plate to move toward and away from the second edge of the first mounting plate and thereby alter the trim of the outboard motor relative to the transom of the boat.

2. The outboard motor mounting apparatus of claim 1, comprising an actuator configured to be coupled to the axle and the coupling and configured to extend and retract and thereby move the coupling away from the axle and toward the axle, respectively, to cause the first and second mounting plates to pivot relative to one another.

3. The outboard motor mounting apparatus of claim 1, wherein the second mounting plate and the first mounting plate are structured to have a range of motion relative to each other of +10° to −15° in which +10° is when the second edge of the second mounting plate is closest to the second edge of the first mounting plate and −15° is when the second edge of the second mounting plate is farthest away from the second edge of the first mounting plate.

4. The outboard motor mounting apparatus of claim 1, wherein the second mounting plate comprises first and second mounts and the assembly further comprises first and second afterplanes configured to be mounted on the first and second mounts, respectively.

5. The outboard motor mounting apparatus of claim 1, wherein the first mounting plate comprises first and second mounts that each have arms, and the assembly further comprises a transverse member configured to attach to the first and second mounts, the assembly further comprising at least one actuator mounted in parallel with the transverse member and above the arms of the first and second mounts, the actuator including a link rod attached to the outboard motor.

6. A vessel, comprising:

a transom; and an outboard motor mounting apparatus to attach to the transom of the vessel, the outboard motor mounting apparatus comprising:

a first mounting plate to attach to the transom and having a first body with a first edge and a second edge that opposes the first edge, at least two legs extending adjacent the first edge of the first body and at least one arm extending adjacent the opposing second edge of the first body, the at least one arm having a first elongate opening;

a second mounting plate to attach to the outboard motor and having a second body with a first edge and a second edge that opposes the first edge, at least two legs extending adjacent the first edge of the second body and at least one arm extending adjacent the opposing second edge of the second body, the at least one arm having a second elongate opening;

an axle extending through the at least two legs of the first mounting plate and the at least two legs of the second mounting plate to enable pivotal movement of the second mounting plate relative to the first mounting plate; and a coupling configured to extend through the first and second elongate openings in the arms of the first and second mounting plates and configured to cooperate with the first and second elongate openings to enable the second edge of the second mounting plate to move toward and away from the second edge of the first mounting plate and thereby alter the trim of the outboard motor relative to the transom of the boat.

7. The vessel of claim 6, comprising an actuator configured to be coupled to the axle and the coupling and configured to extend and contract and thereby move the coupling away from the axle and toward the axle, respectively, to cause the first and second mounting plates to pivot relative to one another.

8. The vessel of claim 6, wherein the second mounting plate and the first mounting plate have a range of motion relative to each other of +10° to −15° in which +10° is when the second edge of the second mounting plate is closest to the second edge of the first mounting plate and −15° is when the second edge of the second mounting plate is farthest away from the second edge of the first mounting plate.

9. The vessel of claim 6, wherein the first mounting plate comprises first and second mounts and the outboard motor mounting apparatus further comprises first and second afterplanes configured to be mounted on the first and second mounts, respectively.

* * * * *